US007484939B2

(12) United States Patent
Hansen

(10) Patent No.: US 7,484,939 B2
(45) Date of Patent: Feb. 3, 2009

(54) VARIABLE DISPLACEMENT RADIAL PISTON PUMP

(75) Inventor: Lowell Dean Hansen, Brandon, MS (US)

(73) Assignee: Eaton Corporation, Cleveland, OH (US)

( * ) Notice: Subject to any disclaimer, the term of this patent is extended or adjusted under 35 U.S.C. 154(b) by 528 days.

(21) Appl. No.: 11/016,127

(22) Filed: Dec. 17, 2004

(65) Prior Publication Data

US 2006/0222512 A1 Oct. 5, 2006

(51) Int. Cl.
*F04B 1/06* (2006.01)
*F04B 49/00* (2006.01)

(52) U.S. Cl. ..... 417/221; 417/218; 417/219; 417/220

(58) Field of Classification Search ..... 417/218–221, 417/273; 92/12.1; 91/491, 497
See application file for complete search history.

(56) References Cited

U.S. PATENT DOCUMENTS 2,205,913 A * 6/1940 Stacy ..... 91/487
2,557,508 A 6/1951 Leibing
3,357,362 A * 12/1967 Orr ..... 92/58
3,626,810 A 12/1971 Morey
4,601,641 A * 7/1986 Kuroyanagi et al. ..... 417/220
5,032,065 A * 7/1991 Yamamuro et al. ..... 417/428
5,079,994 A 1/1992 Berbuer
5,183,392 A 2/1993 Hansen
5,374,165 A * 12/1994 Fahnle ..... 417/273
5,561,301 A 10/1996 Inoue
5,752,427 A * 5/1998 Leutner ..... 91/497
5,865,087 A * 2/1999 Olson ..... 91/497
2004/0065192 A1 4/2004 Akasaka et al.

FOREIGN PATENT DOCUMENTS

GB 1 289 500 9/1972
GB 1 465 876 3/1977
WO WO 02/081921 A1 10/2002

* cited by examiner

*Primary Examiner*—Devon C Kramer
*Assistant Examiner*—Patrick Hamo
(74) *Attorney, Agent, or Firm*—Bradley J. Dieorich

(57) ABSTRACT

A radial pump has a housing with a cylinder ring is pivotally mounted therein. The cylinder ring has a circular aperture within which a cam surface is formed. A cylinder block rotates within the cylinder ring aperture and has a plurality of radially extending cylinders each having port which selectively communicates with a fluid inlet and a fluid outlet as the cylinder block rotates. A plurality of pistons is slideably received within the cylinders and engages the cam surface. An actuator operably coupled to produce movement of the cylinder ring, which alters the spatial relationship between the cylinder ring and the cylinder block to vary the amount that the pistons move within the cylinders. The amount of movement of the pistons within the cylinders is directly related to the magnitude of fluid flow delivered by the pump and moving the cylinder ring thereby controls the fluid flow.

18 Claims, 3 Drawing Sheets

VARIABLE DISPLACEMENT RADIAL PISTON PUMP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to rotary pump, and more specifically to high speed piston pumps having variable displacement, such as for use in aircraft fuel and hydraulic systems for pumping, metering and control for aircraft systems including engines.

2. Description of the Related Art

Fixed displacement pumps are conventionally employed as fuel pumps for aircraft turbine engines. Such pumps must be capable of providing sufficient fuel pressure and flow to the engine over a wide range of operating speeds from starting to full throttle operation. Therefore, a common practice is for the pump to produce a relatively high output flow rate at all times. The fuel system meters the pump output flow to supply fuel at a rate that is actually required by the engine. The excess flow from the pump bypasses the engine and is recycled to the pump inlet.

However, circulation in the bypass circuit heats the fuel, which may become excessively hot, especially when a relatively low flow fuel flow rate is demanded by the engine. As a result, a heat exchanger typically is provided in the bypass circuit to cool the fuel before returning it to the pump inlet. This adds complexity, weight and expense to the fuel system.

Size and weight are also important characteristics of components used in aircraft. Thus it is desirable to refine existing piston pump technology to reduce the size, reduce the weight, and increase the operating limits for speed, while providing a high degree of pump reliability.

SUMMARY OF THE INVENTION

A radial piston pump has a housing with a cavity into which a fluid inlet passage and a fluid outlet passage open. A cylinder ring is located within the cavity and has an aperture within which a cam surface is formed. In a preferred embodiment, the cylinder ring is pivotally supported within the cavity and has a circular aperture with a bearing ring therein that forms an interior cylindrical cam surface, for example.

A cylinder block is mounted for rotation within the aperture of the cylinder ring and has a plurality of radially extending cylinders. Each radially extending cylinder has a port, which selectively communicates with the fluid inlet passage and a fluid outlet passage as the cylinder block rotates. A plurality of cylinders pistons, which are free to slide, are received within the plurality of cylinders and engage the cam surface of the cylinder ring. An actuator is operably coupled to produce movement of the cylinder ring, which alters the spatial relationship between the cylinder ring and the cylinder block to vary the distance that the pistons move within the cylinders.

The magnitude of fluid flow produced by the pump is directly related to the stroke of the pistons, (amount of movement) within the cylinders as the cylinder block rotates. Therefore, varying the position of the cylinder ring in relation to the cylinder block controls the magnitude of fluid flow.

DETAILED DESCRIPTION OF THE INVENTION

The present invention is being described in the context of a fuel pump for a gas turbine engine for an aircraft, however it should be appreciated that the novel concepts of this invention have application to a wide variety of pumps for other fluids and equipment.

Figure 1:
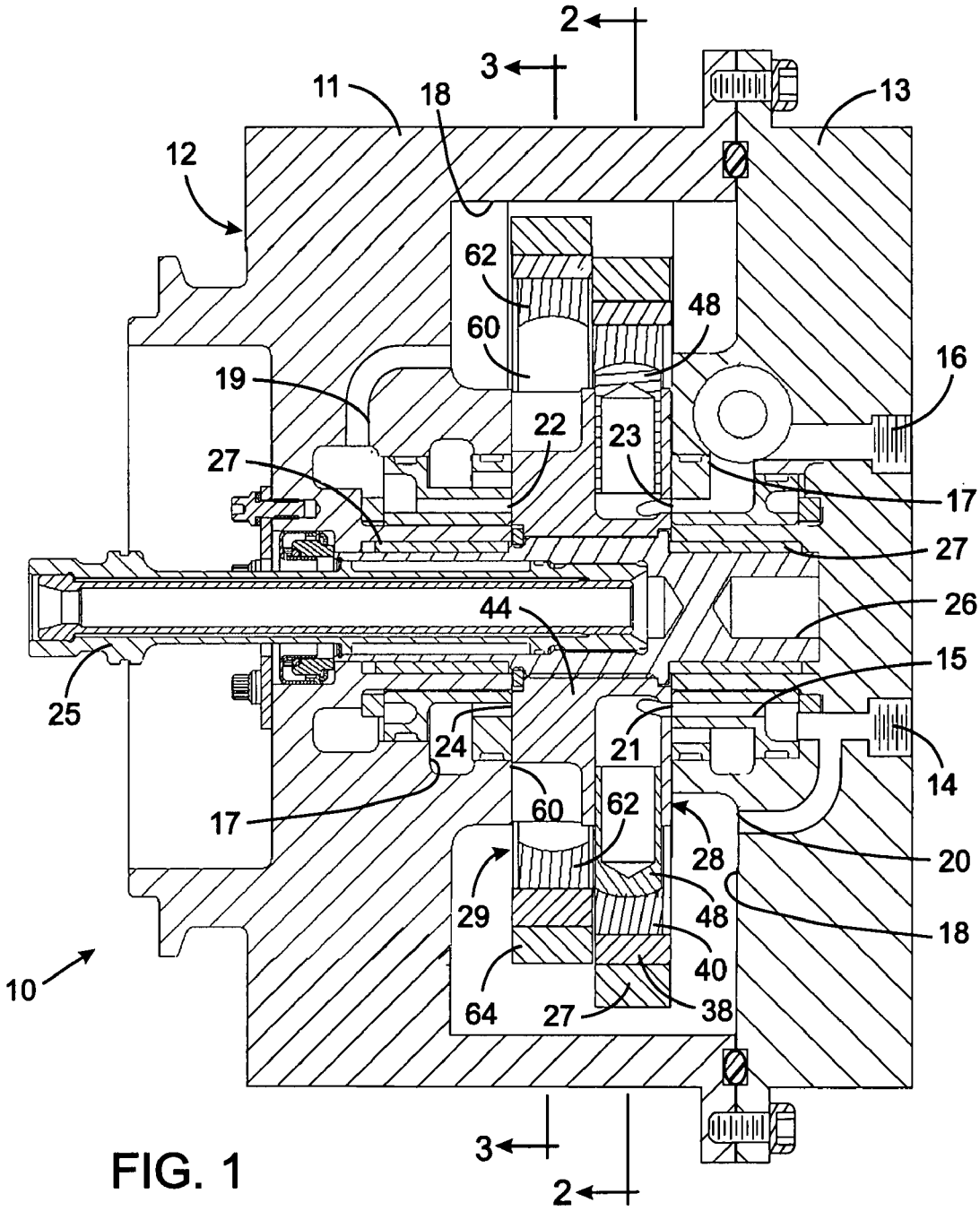
FIG. 1 is an axial cross section through a radial piston pump according to the present invention.

With reference initially to FIG. 1, a pump 10 has a housing 12 formed by first and second segments 11 and 13 that are secured together by bolts or other suitable fasteners with a seal there between. An internal cavity 18 is formed between the two housing segments. A drive shaft 25 projects into the housing 12 through an aperture on one side and engages a pump shaft 26 that extends across the internal cavity 18 and is rotatably mounted in the housing by bearings or bushings 27. The drive shaft 25 conveys power from the engine gearbox to the pump shaft 26 which is mounted between first and second pump sections 28 and 29 within the housing. Note that the walls of the internal cavity 18 project closer together in a central region adjacent the pump shaft 26 than in an annular outer region farther away from that shaft and those walls abut the first and second pump sections 28 and 29 in that central cavity region.

An inlet port 14 in the housing 12 is connected by an inlet passage 15 with two branches that lead through the second housing segment 13 to two inlet passage openings 20 and 21 into the internal cavity 18. A secondary inlet passage 19 in the first housing segment 11 extends from the outer region of the internal cavity 18 to another inlet passage opening 22 in the central region of the cavity. When the pump 10 is operating, a portion of the fluid introduced into the inlet port 14 flows from opening 20 through the outer region of the internal cavity 18 into the secondary inlet passage 19 and continues to flow to the inlet passage opening 22. An outlet passage 17 extends through the housing 12 from separate openings 23 and 24 in each housing segment 11 and 13, respectively, to an outlet port 16. Note that a portion of the outlet passage 17 extends through the housing 12 behind the internal cavity 18 and is not visible in the cross sectional view of FIG. 1. The inlet and outlet passage openings 21-24 open through the walls in that central region of the internal cavity 18 in relatively close proximity to the axis of shafts 25 and 26 to lower the inlet pressure requirements which improves cylinder block filling and reduces potential cavitation damage. Inlet passage opening 20 is in the outer cavity region.

The two pump sections 28 and 29 are identical, but are shown rotated 180 degrees about the pump shaft with respect to each other. Other angles may be selected depending on application requirements. As a consequence, the openings 21 and 23 of the inlet and outlet passages 15 and 17 for the first pump section 28 are oriented 180 degrees around the pump shaft axis with respect to the openings 22 and 24 of the inlet and outlet passages 19 and 17 for the second pump section 29. That is in the orientation of FIG. 1 the inlet opening 21 for the first pump section 28 is below the pump shaft 26 whereas the inlet opening 22 for the pump section 29 is above the pump shaft. The respective outlet openings 23 and 24 are likewise on opposite sides of the pump shaft 26. Inlet and outlet passage openings 21-24 abut the hub of a cylinder block 44.

Figure 2:
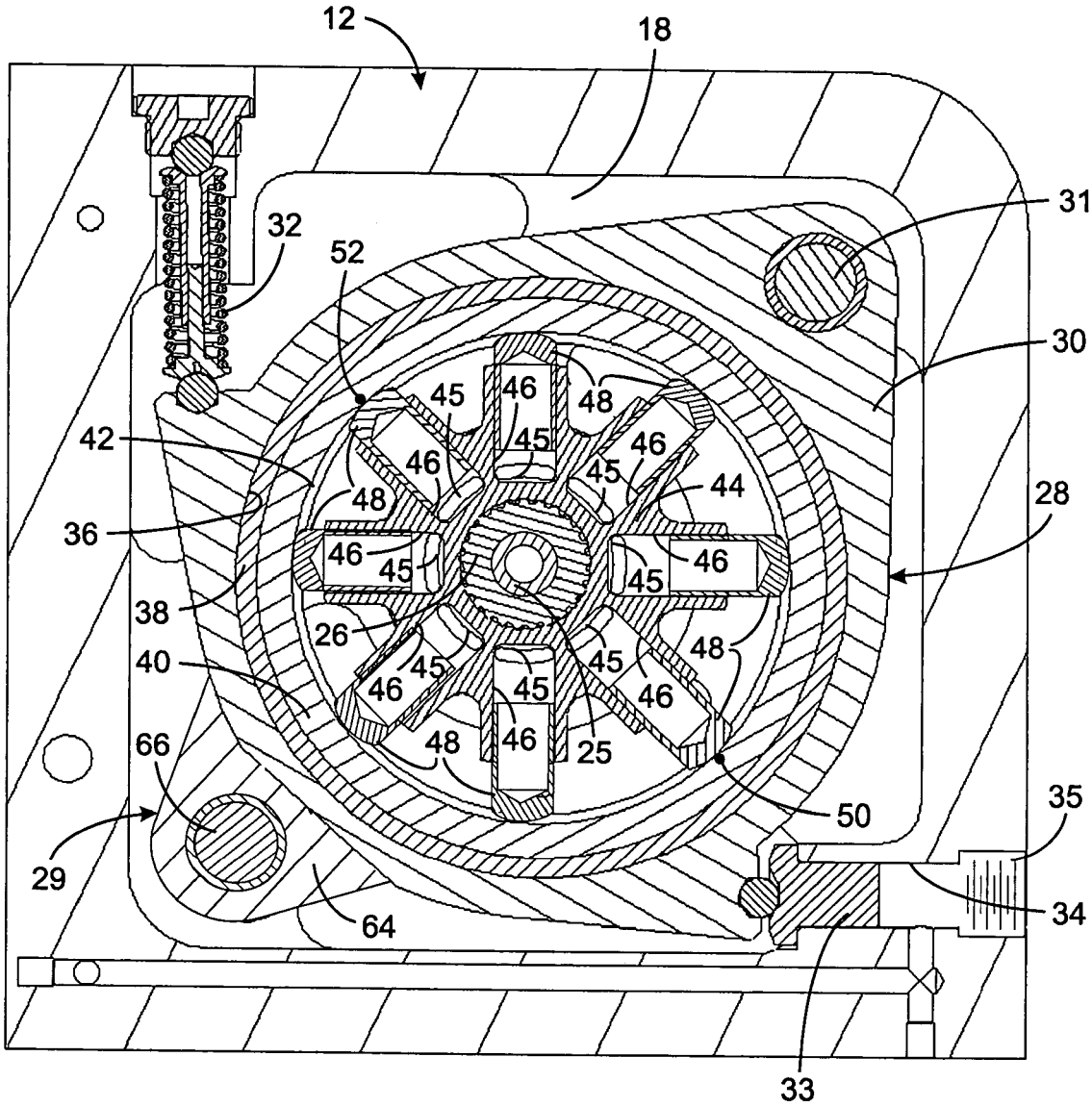
FIG. 2 is a cross section along line 2-2 in FIG. 1.
Figure 3:
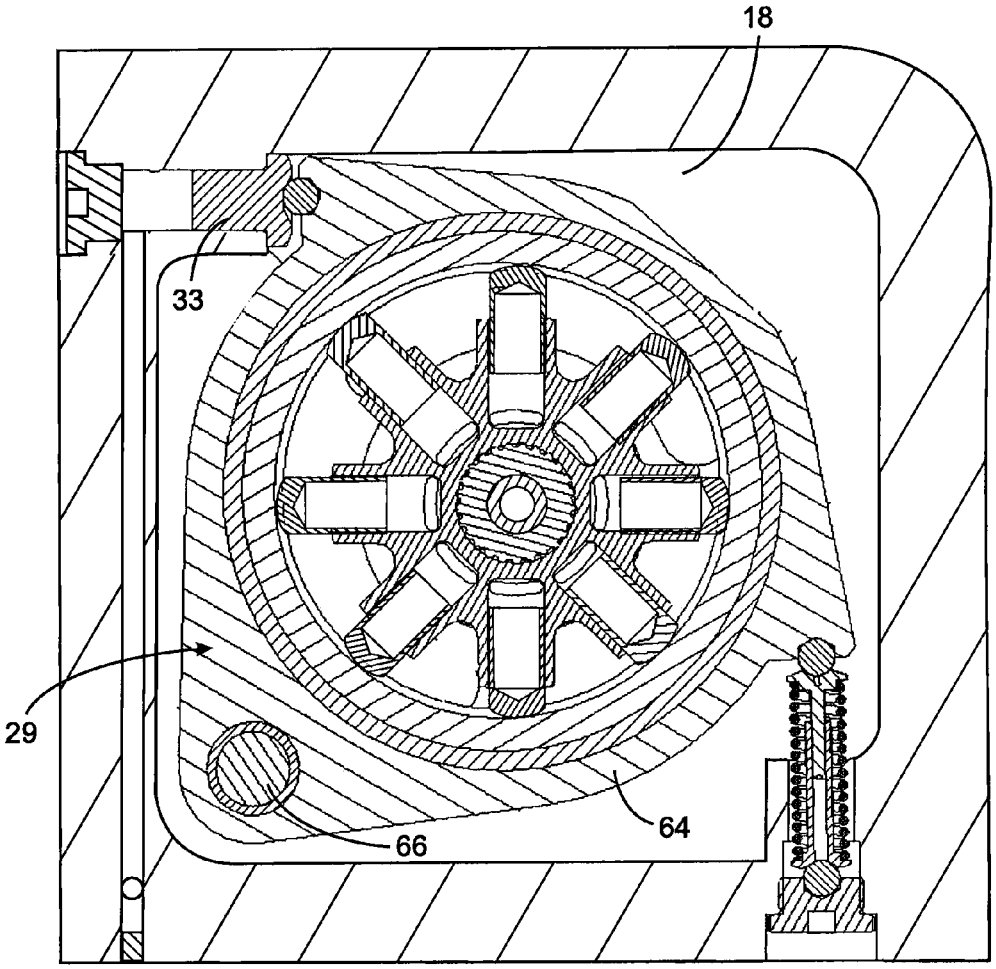
FIG. 3 is a cross section along line 3-3 in FIG. 1.

The first pump section 28 is shown in detail in FIG. 2 and comprises a cylinder ring 30, which is mounted within the housing 12 on a pivot pin 31 that passes through an aperture in one corner of the cylinder ring. Other means of locating the pivot pin 31 may also be used dependent on package space available. A spring 32 the engages housing 12 and pivotally biases the cylinder ring 30 into one extreme rotational position within the cavity 18 that is illustrated in the drawings. As will be described, the first pump section produces a maximum fluid flow in this extreme rotational position. An actuation piston 33 is located within a control bore 34 in the housing 12 and engages a corner of the cylinder ring 30 that is opposite to the engagement point of the spring 32. Introduction of pressurized fluid into the bore 34 via a control port 35 pushes the actuation piston 33 outward thereby that exerting a force, which rotates the cylinder ring 30 clockwise about the pivot pin 31, against the force of the spring 32. Other locations of the actuation piston 33 and spring 32 may also be used dependent on the application requirements.

The cylinder ring 30 has a circular aperture 36 through which the drive and pump shafts 25 and 26 extend. An annular bushing 38 is located within the circular aperture 36 and a bearing ring 40 is slideably received within the annular bushing. The inner circumferential surface of the bearing ring 40 has an annular groove that forms a cam surface 42 against which a first plurality of valve pistons 48 travel, as will be described. Although the preferred embodiment of the cylinder ring 30 has a circular aperture 36, that aperture and thus the inner circumferential surface of the bearing ring 40 may have other geometric shapes. It should also be noted that bearing shoes might be placed between the bearing ring 40 and the piston 48.

The first pump section 28 is formed by a portion of the cylinder block 44 and fastened to the pump shaft 26 so as to rotate therewith. The cylinder block 44 has a first set of eight cylinders 46 arranged equal distantly around and extending radially outward from the axis of the pump shaft 26. The interior end of each cylinder has a kidney shaped cylinder port 45 in the cylinder block 44. In different rotational positions of each cylinder 46, its port 45 communicates with the opening 21 of the inlet passage 15 or the opening 23 of the outlet passage 17 shown in FIG. 1. A separate piston 48 is slideably received within each cylinder 46. Each piston 48 has an open end facing the center of the cylinder block 44 and a closed end with a curved outer surface that fits within the groove of the cam surface 42 on the bearing ring 40. As the cylinder block 44 rotates upon being driven by the drive and pump shafts 25 and 26, the pistons 48 are driven outward into engagement against the bearing ring 40 by centrifugal forces. Drag forces produced by the engagement of the pistons 48 may cause the bearing ring 40 to rotate within the central opening of the cylinder ring 30.

In the maximum flow configuration of the pump, the spring 32 pivots the cylinder ring 30 into the extreme counter-clockwise position as illustrated in FIG. 2. It should be noted that the pump shaft 26 and the cylinder block 44 remain in a fixed orientation with respect to the pump housing 12 as the cylinder ring 30 pivots. Therefore in the maximum flow configuration, the aperture 36 of the cylinder block 44 is non-coaxially oriented (i.e. eccentrically) within the cam surface 42 of the bearing ring 40. This results in a larger gap existing between the cylinder block 44 and the bearing ring 40 at a bottom dead center point 50 than at a diametrically opposite top dead center point 52. As a consequence, the pistons 48 are forced farther out of the cylinders 46 adjacent the bottom dead center point 50 than near the top dead center point 52. The inlet passage opening 21 for the first pump section 28 is a curved opening that is centered between the bottom dead center point 50 and the top dead center point 52 in the housing wall on one side of the pump shaft 26. Similarly the outlet passage opening 23 for the first pump section 28 is a curved opening that is centered between the bottom and top dead center points 50 and 52 on the other side of the pump shaft 26.

As the cylinder block 44 rotates so that a given cylinder 46 is approaching the bottom dead center point 50, the piston 48 within that cylinder is moving outward thereby expanding the volume of the cylinder chamber. The direction of rotation is such that as the cylinder chamber is expanding, the port 45 for the given cylinder communicates with the inlet passage opening 21 so that fluid is drawn into the cylinder chamber. At the bottom dead center point 50, the cylinder port 45 is adjacent solid wall of the housing and no longer communicates with the inlet passage opening 21. As the cylinder block 44 rotates away from the bottom dead center point 50, the port 45 of the given cylinder 46 is exposed to the outlet passage opening 23. Continued rotation of the cylinder block 44 moves the piston 48 into a region where the gap between the cylinder block 44 and the bearing ring 40 decreases thereby pushing the piston into the given cylinder. This action forces the fluid from the cylinder into the outlet passage 17, pressure resulting from restriction to the fluid flow.

As the given cylinder 48 passes the top dead center point 52, its port 45 is closed off from both the inlet and outlet passage openings 21 and 23. Further rotation of the cylinder block 44 thereafter causes the piston 48 to move out of the given cylinder 46, which expands the cylinder chamber, while the cylinder port 45 communicates with the inlet passage opening 21 thereby repeating the pumping cycle.

By applying different levels of pressure into the control bore 34; the pump actuation piston 33 is operated to pivot the cylinder ring 30 into different positions within the cavity 18. The pivoting of the cylinder ring 30 changes the spatial relationship of the bearing ring 40 to the cylinder block 44, thereby changing the annular gap between those components. Specifically, pivoting the cylinder ring 30 changes the distance of the gap at the bottom dead center point 50 and the top dead center point 52. This varies the amount of piston travel within each cylinder as the pistons revolve around the axis of the pump shaft 26 and thus alters the amount of fluid delivered by the pistons.

As noted previously, FIG. 2 illustrates the cylinder ring 30 in the maximum flow configuration in which the largest gap exists between the cylinder block 44 and the bearing ring 40 at the bottom dead center point 50 and the smallest gap exists at the top dead center point 52. As pressure in the control bore 34 increases the actuation piston 33 moves farther outward thereby exerting force on the cylinder ring 30, which rotates clockwise, toward a position in which the bearing ring 40 is coaxial (e.g. concentric) to with the cylinder block 44. This motion of the cylinder ring 30 decreases the gap between the bearing ring 40 and the cylinder block 44 at the bottom dead center point 50 and increases the gap at the top dead center point 52. As the difference between the size of the gaps at the bottom and top dead center points 50 and 52 diminishes so too does the flow delivered by the pump. In the opposite extreme pivotal position to that illustrated in FIG. 2, the gaps between the cylinder block 44 and the bearing ring 40 at the bottom and top dead center points 50 and 52 are substantially equal thereby producing minimum flow from the pump 10. The design may also be configured to reverse the inlet and discharge ports to reverse the direction of flow delivery. Therefore, varying the pressure of the fluid applied to the control bore 34, controls the flow of fluid delivered by the pump.

The cylinder block 44 has a second set of eight cylinders 60 arranged parallel to the first set of cylinders 46, which form the second pump section 29 which are visible in FIG. 1. A second plurality of valve pistons 62 are slideably located within the second set of cylinders 60 with those pistons traveling against a cam surface of a second cylinder ring 64 that is pivotally attached to the housing 12 by a pivot pin 66. The second cylinder ring 64 is oriented 180° with respect to the first cylinder ring 30. As a consequence, the bottom and top dead center points of the second cylinder ring 64 are rotated 180° with respect to the corresponding points on the first cylinder ring 30. This balances the forces that the flow of fluid and operation of the pistons exert on the cylinder block 44 and shafts 25 and 26. The components of the second pump section 29 function in the same manner as just described for the first pump section 28. However the ports of the second set of cylinders 60 communicating with the inlet and outlet passage openings 22 and 24 in the first housing segment 11 are 180 degrees apart with respect to each other from those in the first segment. Application of pressure to the control port 35 moves both cylinder rings 30 and 64 in unison. This is accomplished by the location of a contact arm on both of the cylinder blocks, which cause the cylinder rings to move with respect to each other (feature not shown).

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. A radial pump comprising a housing having a cavity with an axis there through and having a fluid inlet passage and a fluid outlet passage opening into the cavity;

a first cylinder ring mounted within the cavity on a first pivot that engages the housing and having a first aperture within which a first cam surface is formed;

a second cylinder ring mounted within the cavity on a second pivot that engages the housing on an opposite side of the axis from the first pivot, and the second cylinder ring having a second aperture within which a second cam surface is formed;

a second pivot that is on an opposite side a cylinder block mounted for rotation about the axis within the first and second apertures and including a first plurality of radially extending cylinders and a second plurality of radially extending cylinders, wherein each cylinder has a port which communicates with the fluid inlet passage and the fluid outlet passage as the cylinder block rotates;

a first plurality of pistons, each slideably received within a different one of the first plurality of cylinders and engaging the first cam surface of the first cylinder ring;

a second plurality of pistons each slideably received within a different one of the second plurality of cylinders and engaging the second cam surface of the second cylinder ring; and an actuator mechanism operably coupled to move the first cylinder ring and the second cylinder ring and altering a spatial relationship between each cylinder ring and the cylinder block, which varies an amount that each piston moves upon rotation of the cylinder block.

2. The radial pump as recited in claim 1 wherein the a second pivot is 180 degrees around the axis from the first pivot.

3. The radial pump as recited in claim 1 wherein the fluid outlet passage opens into the cavity at a first inlet opening and at a second inlet opening; and the outlet passage opens into the cavity at a first outlet opening and at a second outlet opening.

4. The radial pump as recited in claim 3 wherein the first and second inlet openings are located on opposite sides of the axis, and the first and second outlet openings are located on opposite sides of the axis.

5. The radial pump as recited in claim 1 wherein the actuator mechanism moves the first cylinder ring and the second cylinder ring independently of each other.

6. The radial pump as recited in claim 1 wherein the actuator mechanism comprises a first actuation piston that engages the first cylinder ring and a second actuation piston that engages the second cylinder ring.

7. The radial pump as recited in claim 6 further comprising a spring arrangement biasing the first cylinder ring into engagement with the first actuation piston and biasing the second cylinder ring into engagement with the second actuation piston.

8. The radial pump as recited in claim 1 wherein the actuator mechanism comprises a first control bore and a second control bore within the housing, a first actuation piston slideably received within the first control bore and engaging the cylinder ring, and a second actuation piston slideably received within the second control bore and engaging second cylinder ring.

9. The radial pump as recited in claim 1 further comprising a first bearing ring within the first aperture and forming the first cam surface, and a second bearing ring within the second aperture and forming the second cam surface.

10. The radial pump as recited in claim 1 wherein rotation of the cylinder block causes the first bearing ring to move within the first cylinder ring and the second bearing ring to move within the second cylinder ring.

11. The radial pump as recited in claim 1 further comprising a drive shaft coupled to the cylinder block and extending out of the housing.

12. A radial pump comprising a housing having a cavity with an axis there through and a fluid inlet passage and a fluid outlet passage opening into the cavity, the fluid inlet passage has a first inlet opening and a second inlet opening located substantially 180 degrees around the axis from the first inlet opening and the outlet passage has a first outlet opening and a second outlet opening located substantially 180 degrees around the axis from the first outlet opening;

a first cylinder ring mounted within the cavity on a first pivot that engages the housing and the first cylinder ring having a first aperture within which a first cam surface is formed;

a second cylinder ring mounted within the cavity on a second pivot that engages the housing substantially 180 degrees around the axis from the first pivot, and the second cylinder ring having a second aperture within which a second cam surface is formed;

a cylinder block mounted for rotation about the axis within the first and second apertures and including a first plurality of radially extending cylinders and a second plurality of radially extending cylinders, wherein each cylinder has a port which communicates with the fluid inlet passage and the fluid outlet passage as the cylinder block rotates;

a first plurality of pistons, each slideably received within a different one of the first plurality of cylinders and engaging the first cam surface of the first cylinder ring;

a second plurality of pistons each slideably received within a different one of the second plurality of cylinders and engaging the second cam surface of the second cylinder ring; and an actuator mechanism operably coupled to move the first cylinder ring and the second cylinder ring and altering a spatial relationship between each cylinder ring and the cylinder block, which varies an amount that each piston moves upon rotation of the cylinder block.

13. The radial pump as recited in claim 12 wherein the actuator mechanism comprises a first actuator that moves the first cylinder ring and a second actuator that moves the second cylinder ring independently of the first cylinder ring.

14. The radial pump as recited in claim 12 wherein the actuator mechanism comprises a first actuation piston that engages the first cylinder ring and a second actuation piston that engages the second cylinder ring.

15. The radial pump as recited in claim 14 further comprising a spring arrangement biasing the first cylinder ring into engagement with the first actuation piston and biasing the second cylinder ring into engagement with the second actuation piston.

16. The radial pump as recited in claim 12 wherein the actuator mechanism comprises a first control bore and a second control bore within the housing, a first actuation piston slideably received within the first control bore and engaging the cylinder ring, and a second actuation piston slideably received within the second control bore and engaging second cylinder ring.

17. The radial pump as recited in claim 12 further comprising a first bearing ring within the first aperture and forming the first cam surface, and a second bearing ring within the second aperture and forming the second cam surface.

18. The radial pump as recited in claim 12 wherein rotation of the cylinder block causes the first bearing ring to move within the first cylinder ring and the second bearing ring to move within the second cylinder ring.

* * * * *